United States Patent [19]

Yoshinaga et al.

[11] 4,225,079

[45] Sep. 30, 1980

[54] LIQUID-LIQUID CENTRIFUGAL EXTRACTOR

[75] Inventors: Shoji Yoshinaga; Hirosige Kawano; Matsuzo Todo; Kiyoshi Fujiwara, all of Yamaguchi, Japan

[73] Assignee: Hitachi, Ltd., Tokyo, Japan

[21] Appl. No.: 965,349

[22] Filed: Dec. 1, 1978

[30] Foreign Application Priority Data

Dec. 2, 1977 [JP] Japan ..... 52-143907
Apr. 19, 1978 [JP] Japan ..... 53-45369

[51] Int. Cl.[2] ..... B04B 5/06
[52] U.S. Cl. ..... 233/15
[58] Field of Search ..... 233/15, 19 R, 27, 28, 233/34, 38, 40

[56] References Cited

U.S. PATENT DOCUMENTS

| | | | |
|---|---|---|---|
| 2,652,975 | 9/1953 | Angelo | 233/15 |
| 3,107,218 | 10/1963 | Doyle | 233/15 |
| 3,179,333 | 4/1965 | Claridge | 233/15 |
| 3,202,347 | 8/1965 | Thurman | 233/15 |
| 3,231,183 | 1/1966 | Podbielniak | 233/15 |
| 3,231,185 | 1/1966 | Podbielniak | 233/15 |
| 3,809,375 | 5/1974 | Bonnet | 233/15 |

*Primary Examiner*—George H. Krizmanich
*Attorney, Agent, or Firm*—Thomas E. Beall, Jr.

[57] ABSTRACT

In a liquid-liquid centrifugal extractor wherein a liquid of greater specific gravity is introduced into an inner peripheral portion inside a rotor, while a liquid of smaller specific gravity is introduced into an outer peripheral portion, and the two liquids are brought into direct contact by exploiting the difference of the specific gravities thereof, to move an extract contained in one of the liquids into the other liquid, pipe means or groove-shaped members having a large number of small holes and serving to distribute the liquids are arranged in the outer peripheral portion and the inner peripheral portion inside the rotor in such a manner that they extend in parallel with a shaft for the rotor and that the holes of the means or members in the outer and inner peripheral portions face each other.

20 Claims, 7 Drawing Figures

LIQUID-LIQUID CENTRIFUGAL EXTRACTOR

BACKGROUND OF THE INVENTION

This invention relates to a liquid-liquid centrifugal extractor, and more particularly to the structure of means for distributing a liquid of smaller specific gravity and a liquid of larger specific gravity uniformly within the extractor and method of using the same.

The "liquid-liquid extractor" is an equipment wherein the two liquids of an original solution in which an extract being a noticed component is dissolved and an extractant which cannot be dissolved in the original solution and which dissolves only the extract are brought into direct contact and wherein the extract is caused to migrate into the extractant and is separated. Specifically, the centrifugal extractor brings the two liquids into contact by exploiting the difference of centrifugal forces based on the difference of the specific gravities of the two liquids.

The liquid-liquid centrifugal extractor is equipped with a rotor which is fixed to a shaft in a manner to be concentric therewith. The liquid of greater specific gravity (hereinafter, called the "heavy liquid") is introduced into the inner peripheral portion of the rotor, while the liquid of smaller specific gravity (hereinbelow, called the "light liquid") is introduced into the outer peripheral portion of the rotor. As the shaft and the rotor rotate, the centrifugal forces are generated in the two liquids. Owing to the difference of the specific gravities of the two liquids, the centrifugal forces developing in the respective liquids have different magnitudes. The heavy liquid moves from the inner peripheral side onto the outer peripheral side within the rotor and forms a heavy liquid continuous layer, while the light liquid moves from the outer peripheral side onto the inner peripheral side and forms a light liquid continuous layer. Meanwhile, the extract contained in one liquid dissolves into the other liquid and migrates with the latter liquid. In this way, the extraction of the extract is carried out.

In order to raise the extraction efficiency in such a centrifugal extractor, both the liquids need to be distributed so that the heavy liquid and the light liquid within the rotor may have uniform flows in the circumferential direction and the axial direction of the rotor without any maldistribution and that the contact area between both the liquids may be large. To this end, in a prior art, a plurality of perforated cylinders are arranged within the rotor concentrically with the shaft and at fixed intervals in the radial direction as means for distributing the liquids. An example of the means is illustrated in a drawing on page 119 of "CHEMICAL ENGINEERING, June 11, 1962". The perforated cylinder is provided with small holes at fixed intervals in the circumferential direction and the axial direction. The light liquid and the heavy liquid supplied into the rotor are respectively intercepted by the perforated cylinders to become uniform flows in the circumferential and axial directions, and pass through the small holes in the perforated cylinders to uniformly migrate within the rotor. In passing through the small holes, the liquids become droplets to increase the surface area and to enhance the extraction efficiency.

Depending on the capacity of the extractor, however, such a perforated cylinder becomes 1,000 mm or more in the diameter, 1,000 mm or more in the axial length and 1 to several mm in the thickness, and it is subjected by the rotation to a centrifugal force which is 1,500 times or more greater than the gravity. Due to this centrifugal force, the axial central part of the perforated cylinder expands. For this reason, a stream of the heavy liquid arises chiefly in the central part in the axial direction and a stream of the light liquid arises chiefly in both the end parts in the axial direction, so that the two liquids cannot contact sufficiently and that the extraction efficiency lowers. The cylinder is feared to damage due to the deformation, and the damage is dangerous.

Moreover, in case of the construction as stated above, one liquid is distributed by the perforated cylinder after having flowed into the continuous layer of the other liquid, which gives rise to the inconvenience that both the liquids pass through the same small holes in the opposite directions. In consequence, the flow resistances of the liquids become high, and the flow velocities become low. This is one of causes for a low extraction efficiency as will be described later.

SUMMARY OF THE INVENTION

An object of this invention is to provide a liquid-liquid centrifugal extractor which has a higher extraction efficiency, when used according to the method of the present invention.

In order to accomplish the object, this invention puts means for distributing a heavy liquid and a light liquid into a structure of high bending resistance such as pipe means or groove-shaped member having a plurality of small holes and disposes the distributing means in parallel with a shaft within a rotor. More specifically, a plurality of liquid distributing means are disposed in an outer peripheral portion and an inner peripheral portion inside a rotor, and the means disposed on the outer peripheral side is provided with a plurality of holes which are open towards the inner peripheral side, while the means disposed on the inner peripheral side is provided with a plurality of holes which are open towards the outer peripheral side, so that the heavy liquid spouts into the interior of the rotor from the holes of the means disposed on the inner peripheral side, passes among the means disposed on the outer peripheral side and migrates further outwards and that the light liquid spouts into the interior of the rotor from the holes of the means disposed on the outer peripheral side, passes among the means disposed on the inner peripheral side and migrates further inwards. Preferably the ejection speed of the liquids through the holes is at least as great as 5 m/sec., specifically within the range of 5–10 m/sec.

DETAILED DESCRIPTION OF THE PREFERRED EMBODIMENTS

As previously stated, it is necessary for enhancing the ratio of efficiency that liquids flow uniformly in the axial direction and the circumferential direction within a rotor. It has heretofore been considered that axial and circumferential streams scarcely exist within the rotor on account of a great centrifugal force. Therefore, the small holes of the perforated cylinder in the prior art are provided at uniform intervals in the axial direction and the circumferential direction, and the pitch is made as small as possible.

Figure 1:
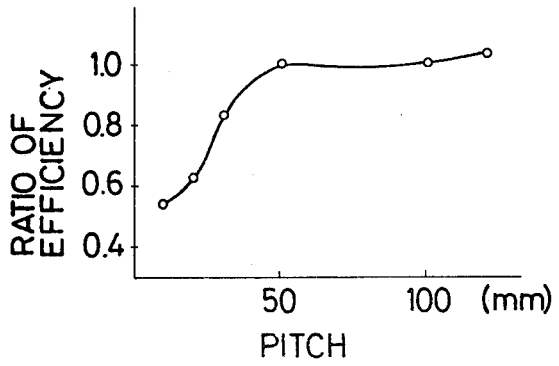
FIG. 1 is a graph showing the relationship between the circumferential pitch of holes provided in liquid distributing means of a liquid-liquid centrifugal extractor and the ratio of efficiency.

As the result of experiments, however, the inventor has found out that the circumferential pitch of the holes does not need to be made small. FIG. 1 shows the result of an experiment which was conducted with a centrifugal extractor having a rotor of an inside diameter of 400 mm. The axis of abscissas represents the circumferential pitch of the holes. The axis of ordinates represents the relative ratio of extraction efficiencies at the time when the pitch was varied, with the extraction efficiency at a pitch of 50 mm being made 1.0. According to FIG. 1, the extraction efficiency rather lowers as the pitch becomes smaller than 50 mm. The reason therefor will be that liquid droplets generated by the distribution interfere with one another due to the circumferential stream of the liquid having passed through the holes. This signifies that the use of the perforated cylinder is not always necessary for making the circumferential pitch small. In order to enhance the extraction efficiency, accordingly, only the axial stream of the liquid may be made uniform. Even when distributing means such as pipe or groove-shaped members are arranged in parallel with a shaft, the maldistribution of the stream of the liquid can be satisfactorily eliminated.

Figure 2:
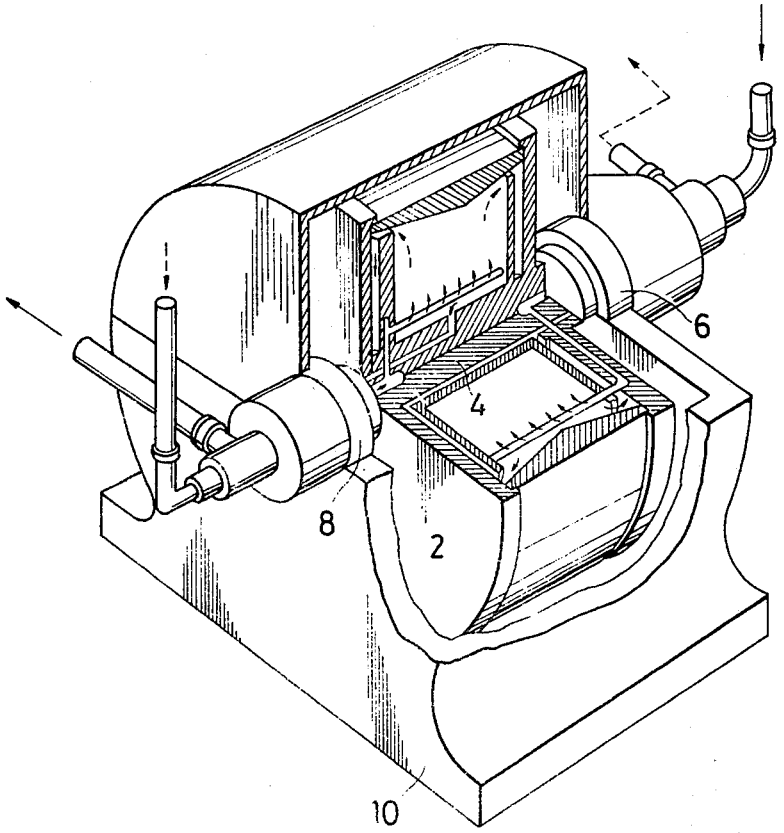
FIG. 2 is a perspective view, partially in section, of a liquid-liquid centrifugal extractor according to this invention.

The whole structure of a liquid-liquid centrifugal extractor according to this invention will be described with reference to FIG. 2. A rotor 2 is coaxially fixed to a shaft 4. The shaft 4 is supported on a base 10 through bearings 6 and 8. Both a heavy liquid and a light liquid are introduced into the interior of the rotor 2 from inlets formed in the shaft 4. After the extraction has been carried out, both the liquids are taken out from outlets formed in the shaft 4. Arrows indicated by solid lines denote the stream of the light liquid, while arrows indicated by broken lines denote the stream of the heavy liquid.

A more detailed structure of the rotor 2 as well as the shaft 4 will be described with reference to FIG. 3. The rotor 2 consists of a cylindrical plate 12 and two side plates 14 and 16 fixed to both ends of the plate 12, and forms a closed space 18 therein. The rotation of a motor (not shown) is transmitted to the shaft 4 through a belt (not shown) as well as a pulley 20 fixed to the shaft 4.

At one end part of the shaft 4, the light liquid inlet 24 and the heavy liquid outlet 26 are open. In the side plate 14 near to the inlet 24 and the outlet 26, an inlet 28 of the light liquid into the rotor 2 and an outlet 30 of the heavy liquid from the rotor 2 are open at an outer peripheral part. The inlet 24 of the light liquid and the inlet 28 thereof into the rotor 2 are communicated by a passageway 32. The outlet 26 of the heavy liquid and the outlet 30 thereof from the rotor 2 are communicated by a passageway 34.

At the other end part of the shaft 4, the heavy liquid inlet 36 and the light liquid outlet 38 are open. In the other side plate 16, an inlet 40 of the heavy liquid into the rotor 2 is open at an inner peripheral part. An outlet 42 of the light liquid from the rotor 2 is open in the shaft 4 inside the rotor 2. The inlet 36 of the heavy liquid and the inlet 40 thereof into the rotor 2 are communicated by a passageway 44. The outlet 38 of the light liquid and the outlet 42 thereof from the rotor 2 are communicated by a passageway 46. Mechanical seals 48 and 50 are disposed at the respective ends of the shaft 4. The delivery and receipt of the heavy liquid and the light liquid are executed between the shaft 4 which rotates and the base which does not rotate.

Figure 4:
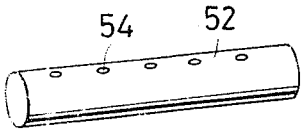
FIG. 4 is a perspective view showing pipe means for distributing a liquid in the liquid-liquid centrifugal extractor according to this invention.

At an outer peripheral part of the interior of the rotor 2, a plurality of pipes 52 as liquid distributing means are disposed in parallel with the shaft 4. The pipe 52 has one end connected with the inlet 28 of the light liquid into the rotor 2, and has the other end closed and retained by the side plate 16. The pipes 52 are arranged at fixed intervals in the circumferential direction of the rotor 2, and their distances from the shaft 4 are all equal. It is preferable to install the pipes 52 in large numbers in the circumferential direction. The reasons therefor are that the amount of unbalance to develop in the rotary body can be lessened, and that the quantity of the liquid to flow through the single pipe 52 diminishes to lower the flow resistance, with the result that the burden of a pump can be moderated. A large number of circular small holes 54 as shown in FIG. 4 are provided in the pipe 52 in a manner to face the side of the shaft 4. The small holes 54 are at fixed intervals in the axial direction.

On the other hand, at an inner peripheral part of the interior of the rotor 2, a plurality of pipes 56 each of which has one end connected with the inlet 40 of the heavy liquid into the rotor 2 and has the other end closed and retained by the side plate 14 are disposed in parallel with the shaft 4. Likewise to the pipes 52, the pipes 56 are arranged at fixed intervals in the circumferential direction of the rotor 2, and their distances from the shaft 4 are all equal. A large number of circular small holes 58 having fixed intervals in the axial direction are provided in the pipe 56 at positions facing the holes 54 of the pipe 52.

In the centrifugal extractor described above, the light liquid enters from the inlet 24 via the passageway 32 into the pipes 52. The light liquid in the pipes 52 spouts from the small holes 54 towards the inner peripheral side of the interior of the rotor 2 uniformly in the axial direction, and is distributed in the form of drops. On the other hand, the heavy liquid enters from the inlet 36 via the passageway 44 into the pipes 56. The heavy liquid in the pipes 56 spouts from the small holes 58 towards the outer peripheral side of the interior of the rotor 2. Owing to the rotation of the rotor 2, both the liquids acquire centrifugal forces. On account of the difference between the specific gravities of both the liquids, the centrifugal force which the heavy liquid obtains is greater than the centrifugal force which the light liquid obtains. Therefore, the heavy liquid moves onto the outer peripheral side of the rotor 2 and the light liquid moves onto the inner peripheral side, to form respective continuous layers 60 and 62. The drops of the heavy liquid and the light liquid pass through the outer continuous layers 62 and 60. Meantime, an extract product in one iquid is captured by the other liquid.

The heavy liquid having migrated onto the outer peripheral side is taken out from the heavy liquid outlet 26 via the passageway 34. The light liquid having migrated onto the inner peripheral side is taken out from the light liquid outlet 38 via the passageway 46.

In case where the pipes 52 and 56 as above stated are used as the liquid distributing means, they have great resistance against bending and are therefore less prone to bend due to the great centrifugal forces. For this reason, the maldistributions of the heavy liquid and the light liquid in the central part in the axial direction and both the end parts inside the rotor 2 do not take place. As a result, the streams of the liquids arise uniformly in the axial direction, and the extraction efficiency can be enhanced.

After having been distributed as the droplets by the small holes 54 and 58 of the pipes 52 and 56, the heavy liquid and the light liquid flow into the continuous layers 62 and 60 of the other liquids respectively. Therefore, the liquids do not pass through the same holes in the directions opposite to each other. Accordingly, the flow resistances of the liquids do not become high, and the flow velocities of the liquids become great.

Moreover, the sectional area of the pipes 52 and 56 can be made much smaller than that of the perforated cylinders having hitherto been used. Therefore, supposing that the liquids are supplied to them under the same pressure, the flow velocities of the liquids become greater in the case of employing the pipes 52 and 56. This fact serves to enhance the extraction efficiency on a ground to be stated below with reference to FIG. 5.

Figure 5:
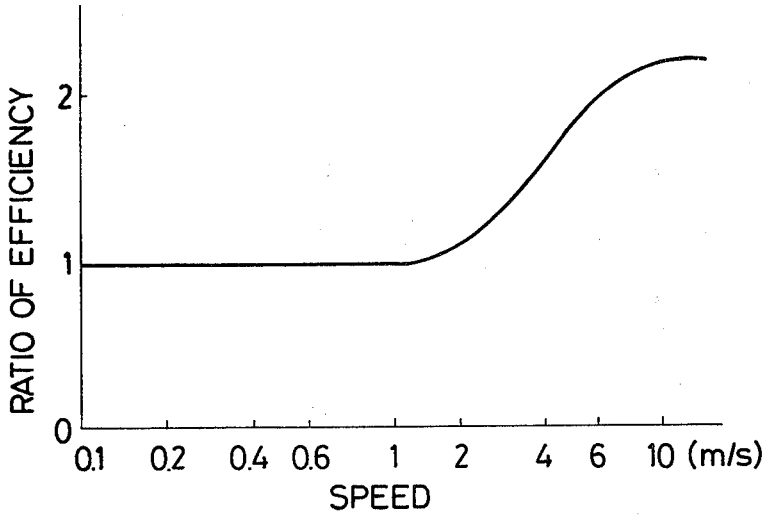
FIG. 5 is a graph showing the relationship between the flow velocity of the liquid passing through the hole of the liquid distributing means and the ratio of efficiency.

With a centrifugal extractor whose rotor had an outside diameter of 300 mm and an axial length of 80 mm, an experiment was conducted by employing water as the heavy liquid, kerosene as the light liquid and n-butyl amine as the extract product. The result is shown in FIG. 5. The axis of abscissas indicates the flow velocity (in m/s) of the liquid passing through the holes of the pipe. The axis of ordinates indicates the relative ratio of the extraction efficiencies depending upon the variation of the flow velocities, with the extraction efficiency at a flow velocity of 0.6 m/s being made 1 (one). According to FIG. 5, when the flow velocity is below 1.5 m/s the extraction efficiency is constant irrespective of the flow velocity, whereas when the flow velocity is above 1.5 m/s the extraction efficiency rises. At a flow velocity of 6 m/s, the extraction efficiency is about double that at a flow velocity of 1.5 m/s.

In this manner, the flow resistances of the liquids are lowered by employing the pipes as the liquid distributing means, whereby to make the flow velocities of the liquids great, with the result that the extraction efficiency can be enhanced.

The inventor conducted an experiment in order to know the relationship between the magnitude of the small holes in the pipes and the extraction efficiency. The variation of the extraction efficiency was investigated while varying the diameter of the holes between 2 mm and 8 mm, but almost no change was observed. As regards the shape of the openings of the pipe, even with rectangular slits which had the same sectional area as that of the circular holes, the extraction efficiency was equal.

From the results of the experiments stated above, it is understood that the magnitude of the flow velocity of the liquid when passing through the hole is the most influential on the extraction efficiency and that the flow velocity should desirably be made above 1.5 m/s.

Figure 6:
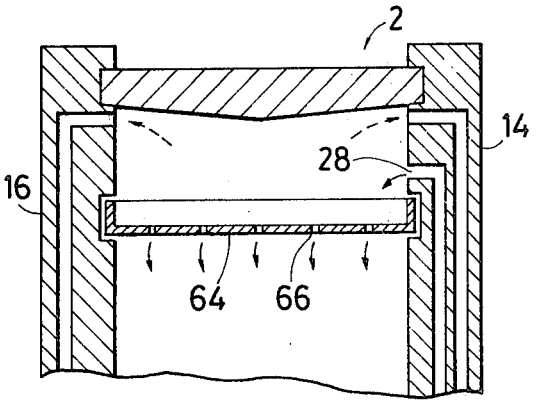
FIG. 6 is a sectional view showing another embodiment of this invention.
Figure 7:
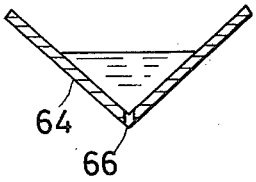
FIG. 7 is a sectional view showing a V-groove-shaped member which is liquid distributing means in FIG. 6.

FIGS. 6 and 7 show another embodiment of this invention. In this embodiment, a V-groove-shaped member 64 is used as the liquid distributing means. In an edge portion of the V-groove-shaped member 64, a large number of small holes 66 are provided at fixed intervals. The member 64 has its ends fixed to the side plates 14 and 16 of the rotor 2, respectively. The V-groove-shaped members 64 on the outer peripheral side of the rotor 2 are disposed slightly inwards of the inlet 28 of the light liquid into the rotor 2. Members (not shown) on the inner peripheral side are disposed slightly outwards of the inlet of the heavy liquid into the rotor 2. The liquid having entered the interior of the rotor 2 from the inlet 28 is received into the grooves of the V-groove-shaped members 64, and is spurted from the small holes 66.

Figure 3:
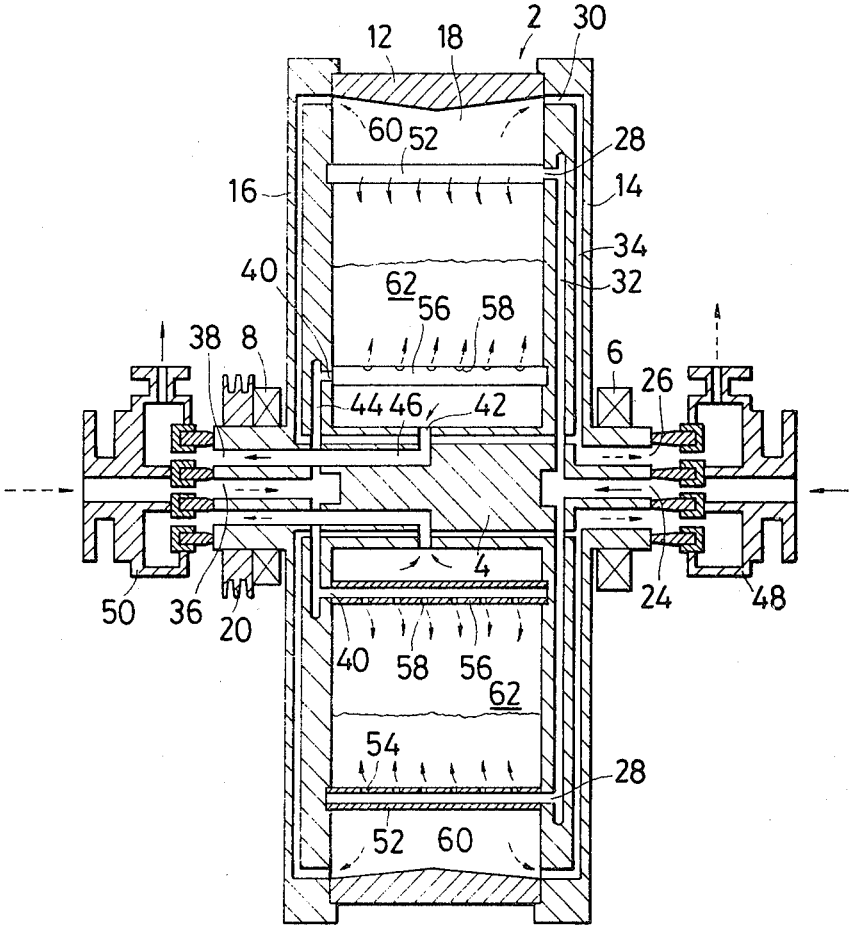
FIG. 3 is a sectional view of a rotor as well as a shaft in the liquid-liquid centrifugal extractor shown in FIG. 2.

In case where the ratio of the quantities of the heavy liquid and the light liquid is close to 1 (one), it is desirable to use the pipes as the distributing means on both the outer peripheral side and the inner peripheral side as illustrated in FIG. 3. In case where the ratio of the quantities of the two liquids is much greater or much smaller than 1 (one), it is desirable to use the V-groove-shaped member in FIG. 6 as the means for distributing the liquid of the smaller quantity and to use the pipe as the means for distributing the liquid of the larger quantity.

What we claim:

1. In a liquid-liquid centrifugal extractor wherein a liquid of greater specific gravity is introduced into an inner peripheral portion inside a rotor, while a liquid of smaller specific gravity is introduced into an outer peripheral portion, and the two liquids are brought into direct contact by exploiting the difference of the specific gravities thereof, to move an extract contained in one of the liquids into the other liquid, the liquid-liquid centrifugal extractor further comprising:

a plurality of liquid distributing means disposed in the outer peripheral portion and the inner peripheral portion inside the rotor, each of the means disposed on the outer peripheral side is provided with a plurality of holes which are open facing the inner peripheral side, while each of the means disposed on the inner peripheral side is provided with a plurality of holes which are open facing the outer peripheral side, so that the liquid of greater specific gravity spouts into the interior of said rotor from said holes of said means disposed on the inner peripheral side, passes among said means disposed on the outer peripheral side and migrates further outwards, while the liquid of smaller specific gravity spouts into the interior of said rotor from said holes of said means disposed on the outer peripheral side, passes among said means disposed on the inner peripheral side and migrates further inwards, said rotor defining in its interior a chamber that is substantially free of any solid elements, except for said distributing means, that would materially deflect or constrain the free movement of the liquids within said chamber.

2. A liquid-liquid centrifugal extractor according to claim 1, wherein said plurality of liquid distributing means are disposed at fixed intervals in a circumferential direction of said rotor.

3. A liquid-liquid centrifugal extractor according to claim 2, wherein said liquid distributing means are pipe means.

4. A liquid-liquid centrifugal extractor according to claim 3, wherein said rotor includes an inlet for the liquid of smaller specific gravity and a separate inlet for the liquid of greater specific gravity, and each of said pipe means has one end connected with an inlet of the liquid into said rotor and has the other end closed.

5. A liquid-liquid centrifugal extractor according to claim 2, wherein said liquid distributing means are groove-shaped members, said members disposed on the outer peripheral side are located slightly inwards of an inlet of the liquid of smaller specific gravity into said rotor, with their edge parts facing the inner peripheral side, while said members disposed on the inner peripheral side are located slightly outwards of an inlet of the liquid of greater specific gravity into said rotor, with their edge parts facing the outer peripheral side, and said holes are provided in the edge parts of said members.

6. A liquid-liquid centrifugal extractor according to claim 5, wherein each of said groove-shaped members has both its ends retained by inner walls of said rotor, so that the liquid having flowed into said rotor stays in the groove of said member, 7. A liquid-liquid centrifugal extractor wherein a liquid of greater specific gravity is introduced into an inner peripheral portion of a rotor chamber, while a liquid of smaller gravity is introduced into an outer peripheral portion, and thereafter the two liquids are brought into direct contact by exploiting the difference of the specific gravities thereof, to move an extract contained in one of the liquids into the other liquid, said liquid-liquid centrifugal extractor comprising:

a base;

a rotor rotatably mounted on said base for rotation about an axis, said rotor having a shaft portion, spaced apart side portions and a peripheral portion spaced from said shaft portion so as to define therebetween a liquid containing chamber that will subject liquid therein to centrifugal force with rotation of said rotor about said axis;

a first plurality of separate liquid distributing means mounted in said rotor, peripherally spaced with respect to each other, radially spaced inwardly from said peripheral portion, extending between said sides in the outer portion of said chamber, and each extending parallel to said shaft for containing therein throughout their axial length the liquid of smaller specific gravity;

a second plurality of separate liquid distributing means mounted on said rotor, peripherally spaced with respect to each other, radially spaced outwardly from said shaft portion, extending between said sides in the inner portion of said chamber and each extending parallel to said shaft for containing therein throughout their axial length the liquid of greater specific gravity;

each of said distributing means including a plurality of holes for discharging respective streams of smaller specific gravity liquid radially inward from where it is held in said distribution means through its respective holes and discharging the greater specific gravity liquid radially outwardly through its holes from where it is held within its distributing means;

said outer distributing means being spaced from each other so as to contain therebetween the liquid of greater specific gravity and said inner distributing means being spaced from each other peripherally so as to containg therebetween the liquid of smaller specific gravity; and said chamber within said rotor being substantially free of any solid element that would materially deflect or constrain the free movement of the liquids within said chamber.

8. A liquid-liquid centrifugal extractor according to claim 7, including first passage means in said rotor for conducting the greater specific gravity liquid from outside of the rotor into said second distributing means and second passage means for conducting the smaller specific gravity liquid from outside of said rotor into said first distributing means;

third passage means opening into said rotor chamber radially outwardly from said first distributing means for conducting the liquid of greater specific gravity from inside said rotor to outside said rotor; and fourth passage means opening into said rotor chamber radially inward of said second distributing means for conducting the smaller specific gravity liquid from inside said chamber to outside of said rotor.

9. The liquid-liquid centrifugal extractor according to claim 8, wherein each of said distributing means has a uniform cross section throughout its entire axial length from side portion to side portion.

10. The liquid-liquid centrifugal extractor according to claim 9, wherein each of said first distributing means includes at least two radially extending side walls and one axially extending inner wall, and each of said second distributing means includes at least two radially extending side walls and one axially extending outer wall, with said holes being respectively in said inner wall and said outer wall of said first and second distributing means.

11. The liquid-liquid centrifugal extractor according to claim 8, wherein each of said first distributing means includes at least two radially extending side walls and one axially extending inner wall, and each of said second distributing means includes at least two radially extending side walls and one axially extending outer wall, with said holes being respectively in said inner wall and said outer wall of said first and second distributing means.

12. The liquid-liquid centrifugal extractor according to claim 7, wherein each of said distributing means has a uniform cross section throughout its entire axial length from side portion to side portion.

13. The liquid-liquid centrifugal extractor according to claim 7, wherein each of said first distributing means includes at least two radially extending side walls and one axially extending inner wall, and each of said second distributing means includes at least two radially extending side walls and one axially extending outer wall, with said holes being respectively in said inner wall and said outer wall of said first and second distributing means.

14. The liquid-liquid centrifugal extractor according to claim 9, wherein each of said distributing means is a pipe.

15. A method of centrifugal liquid extraction, comprising the steps of:

providing a base;

providing a rotor rotatably mounted on said base for rotation about an axis with said rotor having a shaft portion, spaced apart side portions and a peripheral portion spaced from said shaft portion so as to define therebetween a liquid containing chamber that will subject liquid therein to a centrifugal force with rotation of said rotor about said axis;

providing a first plurality of separate liquid distributing means mounted in said rotor peripherally spaced with respect to each, radially spaced inwardly from said peripheral portion, extending between said side portions in the outer periphery of said chamber, and each extending parallel to said shaft for containing therein throughout their axial length the liquid of smaller specific gravity;

providing a second plurality of separate liquid distributing means mounted in said rotor peripherally spaced with respect to each other, radially spaced outwardly from said shaft portion, extending between said sides in the inner periphery of said chamber and extending parallel to said shaft for containing therein throughout their axial length the liquid of greater specific gravity;

providing each of said distributing means with a plurality of holes for discharging respective streams of smaller specific gravity liquid radially inward from where it is held in said distributing means through its respective holes and discharging the greater specific gravity liquid radially outward through its respective holes from where it is held within its distributing means;

providing said outer distributing means spaced from each other so as to contain therebetween the liquid of greater specific gravity and said inner distributing means spaced from each other peripherally so as to contain therebetween the liquid of smaller specific gravity;

introducing the greater specific gravity liquid into the rotor, through said second distributing means, through the holes of said second distributing means at a velocity more than 1.5 m/s, through said rotor chamber, between said first distributing means, and outwardly from said rotor chamber through said rotor, while simultaneously introducing the liquid of smaller specific gravity into said rotor through said second distributing means, through the holes of said second distributing means at more than 1.5 m/s, radially inwardly through said rotor chamber, between said first distributing means, and outwardly through said rotor to exit from said chamber, while simultaneously moving an extract from one of said liquid into the other of said liquids within said chamber;

maintaining the entire chamber within said rotor substantially completely filled with the liquids so as to form an annular boundary between the inner and outer distributing means defined by the liquid of smaller specific gravity filling the chamber inwardly of said boundary and the liquid of greater specific gravity filling the chamber outwardly of said boundary except for the passage of the liquid of smaller specific gravity that is introduced from the first distributing means to the boundary and the passage of the liquid of greater specific gravity that is introduced from the second distributing means to the boundary; and maintaining said chamber between said first distributing means and said second distributing means substantially free of any solid element that would materially deflect or constrain the free movement of the liquids within said chamber.

16. A method of centrifugal liquid-liquid extraction, comprising the steps of:

providing a base;

providing a rotor rotatably mounted on said base for rotation about an axis with said rotor having a shaft portion, spaced apart side portions and a peripheral portion spaced from said shaft portion so as to define therebetween a liquid containing chamber that will subject liquid therein to a centrifugal force with rotation about said axis;

providing first liquid distributing means mounted in said rotor in the outer periphery of said chamber containing therein the liquid of smaller specific gravity;

providing second liquid distributing means mounted in said rotor in the inner periphery of said chamber containing therein the liquid of greater specific gravity;

providing an extract in one of said liquids;

providing each of said distributing means with a plurality of holes;

ejecting one of said two liquids through the holes of its distributing means at a velocity at least as great as 1.5 m/s into said rotor chamber, while simultaneously ejecting the other liquid through the holes of its distributing means into said rotor chamber, while rotating said rotor;

and thereafter contacting the one ejected liquid directly with the other ejected liquid as they move in counterflow past each other by the effect of differential specific gravity between them while simultaneously moving an extract from one of said liquids into the other of said liquids within said chamber.

17. The method of claim 16, further including the step of:

maintaining the entire chamber within said rotor substantially completely filled with the liquids so as to form an annular boundary between the inner and outer distributing means defined by the liquid of smaller specific gravity filling the chamber inwardly of said boundary and the liquid of greater specific gravity filling the chamber outwardly of said boundary except for the passage of the liquid of smaller specific gravity that is introduced from the first distributing means to the boundary and the passage of the liquid of greater specific gravity that is introduced from the second distributing means to the boundary; and maintaining said chamber between said first distributing means and said second distributing means substantially free of any solid elements that would materially deflect or constrain the free movement of the liquieds within said chamber.

18. The method of claim 16, wherein said distributing means are each provided as a tubular member.

19. The method of claim 16, wherein each of said distributing means are provided as means that conducts its liquid along its longitudinal extent to its holes, has a channel shape in cross section perpendicular to its longitudinal extent, and has its channel shape opening radially away from the radial midportion of said chamber and its holes opening through the bottom of its channeled shape towards the radial midportion of said chamber.

20. The method of claim 16, wherein the ejecting of each of said two liquids through its holes is at a velocity within the range of 5 to 10 m/sec.

* * * * *